United States Patent [19]

Ohkoshi et al.

[11] 4,339,694

[45] Jul. 13, 1982

[54] FLAT CATHODE RAY TUBE

[75] Inventors: Akio Ohkoshi, Tokyo; Hiroki Sato, Chiba; Masato Hatanaka, Saitama; Toshio Ohboshi; Sakae Tanaka, both of Tokyo, all of Japan

[73] Assignee: Sony Corporation, Tokyo, Japan

[21] Appl. No.: 233,388

[22] Filed: Feb. 11, 1981

[30] Foreign Application Priority Data

Feb. 15, 1980 [JP] Japan ..... 55-18068

[51] Int. Cl.[3] ..... H01J 29/70; H01J 29/72

[52] U.S. Cl. ..... 315/366; 313/422

[58] Field of Search ..... 315/366; 313/422

[56] References Cited

U.S. PATENT DOCUMENTS

| | | | |
|---|---|---|---|
| 3,226,587 | 12/1965 | Chin | 315/366 |
| 3,379,912 | 4/1968 | Shanafelt | 313/422 |
| 3,395,312 | 7/1968 | Freestone et al. | 313/422 |

*Primary Examiner*—Theodore M. Blum

*Attorney, Agent, or Firm*—Hill, Van Santen, Steadman, Chiara & Simpson

[57] ABSTRACT

A flat cathode ray tube is disclosed in which the deflection of an electron beam in the direction which requires a large deflection angle is carried out by the electromagnetic deflection, while the deflection of the electron beam in the direction which requires a small deflection angle is carried out by electrostatic deflection. Further, in the evacuated envelope of the flat cathode ray tube, there is located a high magnetic permeability body to concentrate the magnetic flux on the electron beam necessary for the electromagnetic deflection. In a certain case, a magnetic material body with the electrical conductivity is used as the high magnetic permeability body so as to provide it with the function of serving as an electrode plate for the electrostatic deflection of the electron beam.

24 Claims, 6 Drawing Figures

FLAT CATHODE RAY TUBE

BACKGROUND OF THE INVENTION

1. Field of the Invention

The present invention relates generally to a flat cathode ray tube, and is directed more particularly to a flat cathode ray tube compact in size.

2. Description of the Prior Art

In an ordinary cathode ray tube such as a television receiver tube an electron gun is so arranged that it faces the phosphor screen of the tube and extends along a direction substantially perpendicular to the phosphor screen to the rear side. Therefore, the depth of the evacuated envelope of the cathode ray tube becomes relatively large.

On the contrary, a so-called flat cathode ray tube is proposed in which the electron gun is located to be extended in the horizontal or vertical direction along the surface of the phosphor screen of the cathode ray tube to make its envelope flat.

In such a prior art flat cathode ray tube, in order to scan the phosphor screen of the tube by the electron beam emitted from its electron gun, electromagnetic deflection means or devices are generally used to deflect the electron beam in both the horizontal and vertical directions. However, the horizontal and vertical electromagnetic deflection devices are complicated in construction and large in thickness, so that the prior art flat cathode ray tube can not sufficiently exhibit its inherent advantage.

Recently, such a flat cathode ray tube has been proposed in which both the horizontal and vertical deflection of the electron beam are carried out electrostatically. In this case, the deflection devices thereof become compact, but deflection distortion is apt to be generated on the deflection in the direction, in which a large deflection angle is required, namely the deflection in the direction substantially perpendicular to the axial direction of the electron gun opposing the phosphor screen. In this case, a large deflection voltage is required and hence large power is necessary for its circuitry.

OBJECTS AND SUMMARY OF THE INVENTION

Accordingly, an object of the present invention is to provide a flat cathode ray tube which is relatively simple in construction.

Another object of the invention is to provide a flat cathode ray tube in which an electron beam can be deflected at high efficiency with less power.

According to the present invention, the deflection of an electron beam in the direction which requires a large deflection angle is carried out by the electromagnetic deflection, while the deflection of the electron beam in the direction which requires a small deflection angle is carried out by the electrostatic deflection. Further, in the evacuated envelope of the flat cathode ray tube of the invention, located is a high magnetic permeability body so as to concentrate the magnetic flux on the electron beam necessary for the electromagnetic deflection. In a certain case, a magnetic body with the electrical conductivity is used as the high magnetic permeability body so as to give it the function of serving as an electrode plate for the electrostatic deflection of the electron beam.

According to an example of the present invention, a cathode ray tube is provided, which comprises:

an evacuated envelope having at least one transparent flat portion;

a phosphor target arranged on the inner surface of said flat portion;

an electron gun arranged within said envelope in laterally spaced in relation to said target for emitting an electron beam along a path parallel with the surface of said flat portion;

first deflection means arranged in said envelope for impinging said electron beam upon said target;

second deflection means comprising a pair of plates put said electron beam therebetween arranged in said envelope for deflecting said electron beam perpendicularly to said surface of said flat portion; and third deflection means arranged adjacent to said envelope in cooperation with said pair of plates for concentrating deflecting flux generated by means of said third means on said electron beam between said pair of plates and for deflecting said electron beam in parallel with said surface of said flat portion, thereby to produce an image on said target.

The other objects, features and advantages of the present invention will become apparent from the following description taken in conjunction with the accompanying drawings.

DESCRIPTION OF THE PREFERRED EMBODIMENT

Figure 1:
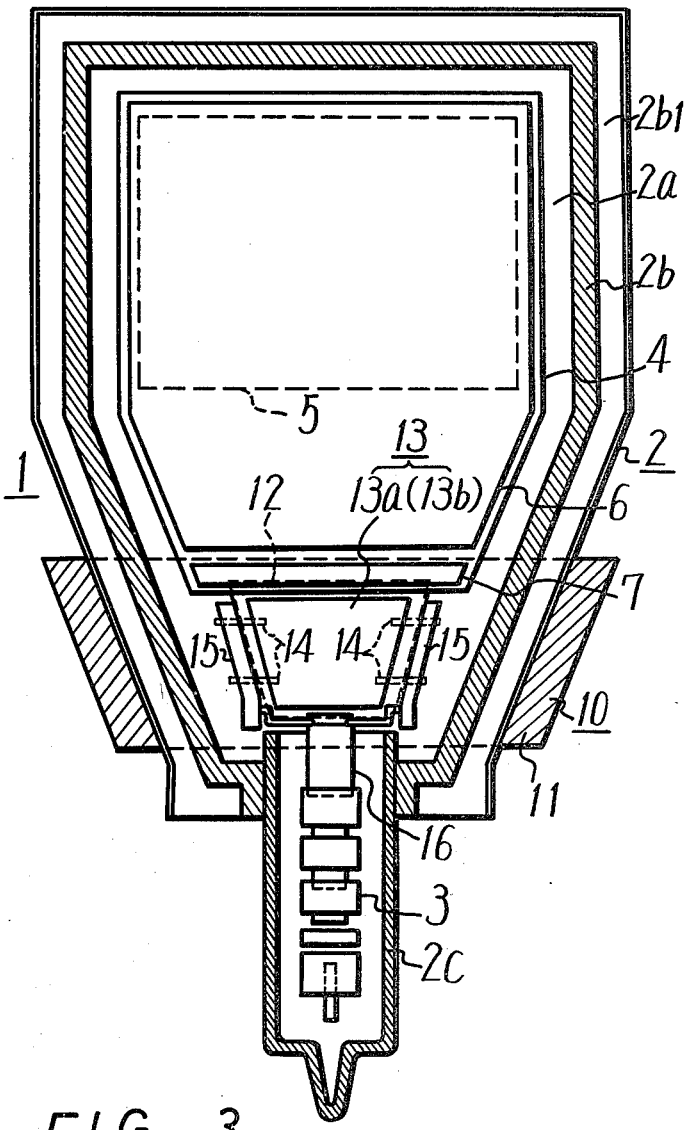
FIG. 1 is a rear view showing partially in cross-section an example of the flat cathode ray tube according to the present invention.

The present invention will be hereinafter described with reference to the attached drawings.

With reference to FIGS. 1 to 4, an example of the flat cathode ray tube according to the invention will be described. In the figures, 1 generally designates a flat cathode ray tube according to the present invention, and 2 denotes its evacuated flat envelope, respectively. This flat envelope 2 comprises a first glass base plate 2*a* of, for example, a plate shape and a second glass base plate 2*b* of a dish-shape with a flange portion $2b_1$ on the periphery thereof. The flange portion $2b_1$ is sealed to the peripheral portion of the base plate 2*a* to define a flat space therein. A neck tube 2*c* is provided on one side of the flat envelope 2 to extend therefrom to the outside along the surface direction of the flat space. An electron gun 3 is located in the neck tube 2*c*. On the inner surface of the base plate 2*a*, coated is a target electrode 4 with the light transmissivity on which phosphor is coated to form a phospor screen 5. It may be also possible that phosphor is first coated on the inner surface of the base plate 2*a* and then a metal back is provided thereon to form the target electrode. Opposing to the target electrode 4, are located a rear electrode 6 and an intermediate electrode 7 at the side of the second base plate 2b. These electrodes 6 and 7 are each made of, for example, a plate-shape electrode and respectively attached through support pins 8 to studs 9, which are each fixed by flit to the inner surface of the base plate 2b, to be fixed at predetermined positions. In this case, the rear electrode 6 is positioned to mainly oppose the phosphor screen 5 while the intermediate electrode 7 is positioned adjacent the electrode 6 and at the side of the electron gun 3. The target electrode 4 and the intermediate electrode 7 are supplied with a high anode voltage of, for example, 5 KV, while the rear electrode 6 is supplied with a high voltage which is lower than the anode voltage, for example, 4 KV. The neck tube 2c and the electron gun 3 are arranged to extend in the surface direction of the flat surface, i.e., in the direction of the surface of the phosphor screen 5. In the illustrated example, the electron gun 3 is so arranged that the axis thereof is along the vertical direction at substantially the center of the picture screen of the phosphor screen 5 and on the surface perpendicular to the phsophor screen 5.

There are respectively provided a deflection device or means which will deflect the electron beam emitted from the electron gun 3 in the direction approximately perpendicular to the axis direction of the electron gun 3 and along the surface direction of the phosphor screen 5 (this deflection will be hereinafter referred to as the horizontal deflection) and a deflection device or means which will deflect the electron beam emitted from the electron gun 3 in the direction perpendicular to the phosphor screen 5 (this deflection will be hereinafter referred to as the vertical deflection). By this horizontal deflection, the electron beam scans the phosphor screen 5 in the horizontal direction, and by the cooperation of the vertical deflection and the deflection based on the voltage difference between the rear electrode 6, intermediate electrode 7 and the target electrode 4 the electron beam scans the phosphor screen 5 in the vertical direction. In this case, accordingly, the deflection angle of the vertical deflection of the electron beam is sufficient as a small angle of, for example, 10° to 20°. As to the horizontal deflection and vertical deflection of the electron beam, for example, the vertical deflection whose deflection angle is small is carried out by the electrostatic deflection, while the horizontal deflection whose deflection angle is large is carried out by the electromagnetic deflection.

As the above deflection means, the horizontal and vertical deflections, i.e., electromagnetic deflection and electrostatic deflection can be carried out by a common deflection means 10 at the same position. This deflection means 10 can be located at, for example, the rear stage of the electron gun 3 and is formed of, for example, an annular magnetic core 11 made of high magnetic permeability material such as ferrite and located to surround the outer periphery of the evacuated envelope 2, an electromagnetic winding 12 through which the horizontal deflection current will flow, and a magnetic body 13 made of high magnetic permeability material and located within the envelope 2.

Figure 4:
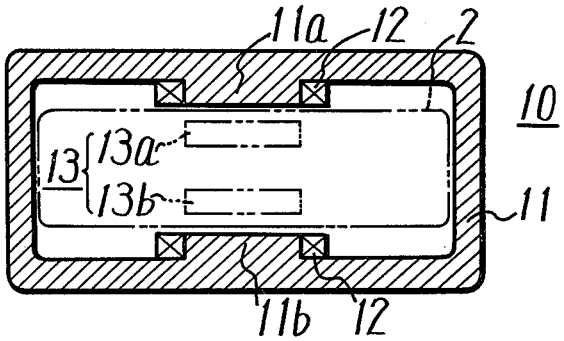
FIG. 4 is a view showing partially in cross-section an example of the deflection means used in the example shown in FIGS. 1 to 3.

Although the magnetic core 11 is formed to be of an annular shape to surround the outer periphery of the envelope 2 with its cross-section shown in, for example, FIG. 4, the magnetic core 11 has provided with center poles 11a and 11b which are each of, for example, a trapezoidal shape, oppose through the electron beam path in the envelope 2 and extend in the thickness direction of the envelope 2. The winding 12 is wound on the outer periphery of the center poles 11a and 11b or one of them in the shape of a saddle. The magnetic flux, corresponding to the horizontal deflection current flowing through the winding 12, is thus generated between the center poles 11a and 11b, i.e., crossing through the envelope 2 to give the magnetic field to the electron beam path in the envelope 2 in the thickness direction thereof.

Figure 2:
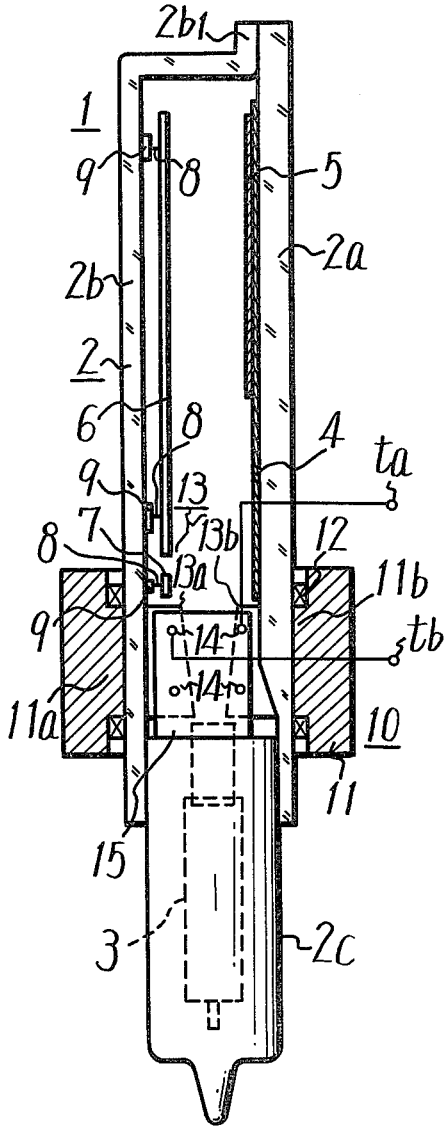
FIG. 2 is a side view thereof with a part in cross-section.
Figure 3:
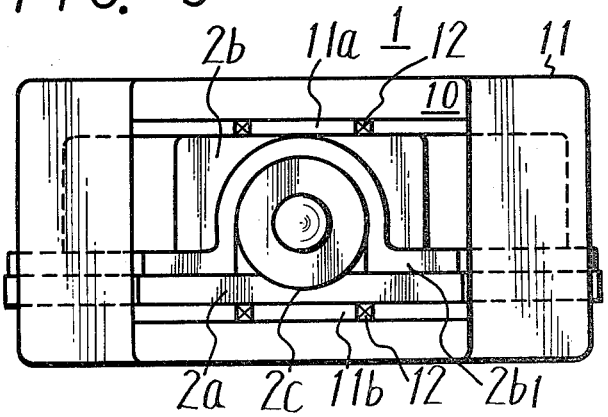
FIG. 3 is a back view thereof.

The high magnetic permeability body 13 is located between the center poles 11a and 11b within the envelope 2 to face the electron beam path. This high magnetic permeability body 13 is formed of a pair of plates 13a and 13b made of, for example, Ni-Zn-Ferrite or Mn-Zn-Ferrite which are located at both sides of the envelope 2 with respect to its thickness direction and oppose each other. Thus, the magnetic flux generated between the center poles 11a and 11b is concentrated on the path of the electron beam. In this example, since the shape of each of the center poles 11a and 11b is selected to be the same as that of the high magnetic permeability body 13, i.e., trapezoidal, the magnetic flux can be concentrated with high efficiency. In this case, each of the high magnetic permeability bodies 13a and 13b for the center poles 11a and 11b is made of a high magnetic permeability body made of such material which is high in resistivity, for example, $10^4$ to $10^7$ Ωcm but has electric conductivity such as ferrite. These high magnetic permeability bodies 13a and 13b are made as the electrostatic deflection plates which will deflect the electron beam in the vertical direction. That is, as shown in FIG. 2, terminals ta and tb are led out from the high magnetic permeability bodies 13a and 13b respectively and the vertical deflection voltage are applied thereacross. In this case, since the deflection means 10 is located at the rear stage of the electron gun 3 or high voltage side, the high magnetic permeability bodies 13a and 13b serving as the electrostatic deflection plates are supplied with an anode voltage such as 5 KV and also the vertical deflection voltage is superimposed on the former.

The high magnetic permeability bodies 13a and 13b may be so arranged that, as shown in FIG. 2, the distance therebetween becomes wide into the rear stage side or the thickness of each of them is made thin from the side of the electron gun 3 to the side of the phosphor screen 5. Further, the high magnetic permeability bodies 13a and 13b may be each formed to be of a sector shape which expands in the direction of the rear stage as shown in FIG. 1. These high magnetic permeability bodies 13a and 13b are each fixed by support pins 14 to insulating bodies 15 made of, for example, ceramic and then coupled to a cylinder 16 which is coaxially coupled to the final cylindrical electrode, for example, fifth grid of the electron gun 3 to be used for positioning or alignment.

As described above, according to the present invention, one of the deflections of the electron beam in the directions substantially perpendicular with each other, i.e., vertical and horizontal directions is carried out by the electromagnetic deflection and the other is carried out by the electrostatic deflection, or, for example, the horizontal deflection whose deflection angle is large is performed by the electromagnetic deflection, while the vertical deflection whose deflection angle is small and which proposes almost no deflection distortion is performed by the electrostatic deflection. Therefore, the apparatus of the invention is small in size as compared with the prior art apparatus in which the deflections in both directions are performed by the electromagnetic deflections, and can perform the deflection with less distortion as compared with the prior art apparatus in which the deflections in both the directions are performed by the electrostatic deflections.

With the present invention, the high magnetic permeability body 13, serving as the electromagnetic deflection means, is located in the envelope 2 to concentrate the magnetic flux on the path of the electron beam, so that when the core 11 with the winding 12 is located outside the envelope 2, even if the distance between, for example, the center poles 11*a* and 11*b*, which will generate the magnetic flux intersecting the envelope 2, becomes large, the magnetic flux density on the electron beam path can be made high and hence the efficiency of the magnetic flux can be increased.

Further, when the high magnetic permeability bodies 13*a* and 13*b* are used as the electrostatic plates for the vertical deflection as described above, the structure of the apparatus can be further simplified to make the apparatus more compact in combination with the fact that the horizontal and vertical deflection means are located at the same position.

Figure 5:
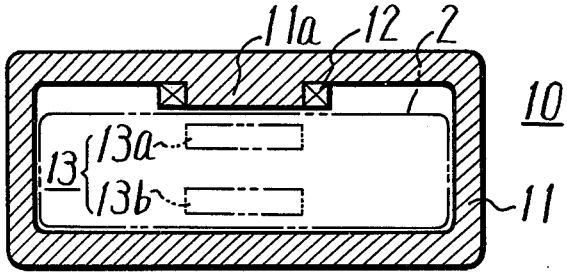
FIGS. 5 and 6 respectively show other examples of the deflection means which can be used in the flat cathode ray tube of the invention.
Figure 6:
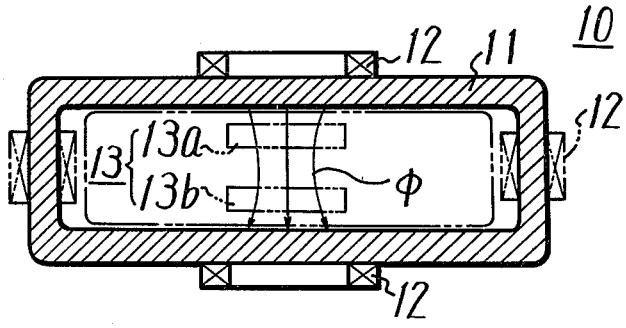

In the above example of the invention, the core 11 of the deflection means 10 is provided with the center poles 11*a* and 11*b* which are located at the both sides thereof to grip the flat envelope 2 therebetween. However, in a certain case, one of the center poles can be omitted as shown in FIG. 5, and also in another case both of the center poles can be omitted as shown in FIG. 6. In the latter case, the winding 12 may be located on the longer sides of the core 11 in the form of the saddle as shown in FIG. 6 by the solid line or on the shorter sides of the core 11 also in the form of the saddle as shown in the same figure by the two-dot-chain line. Even in this case where the center poles are omitted, the distance between the longer sides of the core 11 can be selected sufficiently smaller than that between the shorter sides thereof. Further, due to the provision of the high magnetic permeability bodies 13*a* and 13*b* in the envelope 2 between its longer sides, the magnetic flux $\phi$ which will intersect the envelope 2 along its thickness direction can be generated efficiently.

In the above examples of the invention, the core 11 of the deflection means 10 is located outside the envelope 2. However, in a certain case the core 11 may be located within the envelope 2 along its wall. In this case, the high magnetic permeability bodies 13*a* and 13*b* may be located in the vicinity of or intergral with the opposing longer sides of the core 11. In such a case, if the high magnetic permeability bodies 13*a* and 13*b* has the electrical conductivity, at least one of them requires an air gap or insulating layer to be electrically insulated from the core 11.

Even when such a high magnetic permeability body 13 which has the electrical conductivity is used as set forth above, if it is made to have a sufficiently large resistivity, an eddy current loss can be reduced. In this case, although the resistivity of the high magnetic permeability body 13 is high, since the frequency of the vertical deflection signal is low, there will occur no problem.

It will be apparent that many modifications and variations could be effected by one skilled in the art without departing from the spirit or scope of the novel concepts of the present invention, so that the spirit or scope of the invention should be determined by the appended claims only.

We claim as our invention:

1. A cathode ray tube, comprising:

an evacuated envelope having at least one transparent flat portion;

a fluorescent target arranged on the inner surface of said flat portion;

an electron gun within said envelope in laterally spaced relation to said target for emitting an electron beam along a path parallel with the surface of said flat portion;

first deflecting means in said envelope for impinging said electron beam upon said target;

second deflecting means comprising a pair of plates to put said electron beam therebetween arranged in said envelope for deflecting said electron beam perpendicularly to said surface of said flat portion; and third deflecting means arranged adjacent to said envelope at substantially the same position, along the beam path, as said second, deflecting means in cooperation with said pair of plates for concentrating deflecting flux generated by means of said third means on said electron beam between said pair of plates and for deflecting said electron beam in parallel with said surface of said flat portion, thereby to produce an image on said target.

2. A cathode ray tube according to claim 1, in which said third deflecting means comprises a ring shape core surrounding said envelope and a coil located adjacent to said core for generating magnetic flux perpendicular to the direction of said electron beam emitted from said electron gun.

3. A cathode ray tube according to claim 1, in which each of said plates comprises high magnetic permeable material having the resistivity of between $10^4$ Ω-cm to $10^7$ Ω-cm.

4. A cathode ray tube according to claim 2, in which said core has at least one protruding portion opposite to said pair of plates with said coil wound therearound.

5. A cathode ray tube according to claim 4, in which the plane figure of said protruding portion is similar to that of each said plate.

6. A cathode ray tube according to claim 1, in which said pair of plates are formed of Ni-Zn-Ferrite.

7. A cathode ray tube according to claim 1, in which said pair of plates are formed of Mn-Zn-Ferrite.

8. A cathode ray tube according to claim 1, in which the plane figure of said each plate are substantially of trapezoidal shape such that the width thereof increases in the direction of said electron beam.

9. A cathode ray tube according to claim 1, in which said first deflecting means comprises said target and at least one auxiliary electrode arranged in said envelope which generates an electrostatic field therebetween.

10. A cathode ray tube according to claim 9, in which said auxiliary electrode comprises a rear electrode arranged opposite to said target and an intermediate electrode arranged between said rear electrode and said second deflecting means.

11. A cathode ray tube according to claim 10, in which the voltage applied to said target is the same as that of said intermediate electrode and higher than that of said rear electrode.

12. A cathode ray tube according to claim 9, in which the voltage applied to said target is not lower than that of said auxiliary electrode.

13. A cathode ray tube according to claim 4, wherein the respective plane figures of said pair of plates and said protruding portion are substantially trapezoidal shape such that their width thereof increase in the direction of said electron beam.

14. A cathode ray tube according to claim 1, wherein the opposite surfaces of said pair of plates diverge outwardly from each other in the direction of said electron beam.

15. A cathode ray tube according to claim 1, wherein said pair of plates are supported by a pair of insulator means which put respective opposite sides of said pair of plates therebetween to form an assembly.

16. A cathode ray tube according to claim 15, wherein said insulator means are ceramic.

17. A cathode ray tube according to claim 15, wherein said pair of plates and said pair of insulator means are mechanically fixed to each other by means of a plurality of pins.

18. A cathode ray tube according to claim 15, wherein said pair of plates and said pair of insulator means are mechanically fixed to each other by means of glass material.

19. A cathode ray tube according to claim 15, wherein said assembly is mechanically fixed to the inner surface of said envelope.

20. A cathode ray tube according to claim 15, wherein said assembly are electrically and mechanically connected to the end portion of said electron gun.

21. A cathode ray tube according to claim 20, wherein means for aligning the axis of said electron gun with that of said assembly is arranged therebetween.

22. A cathode ray tube according to claim 1, wherein said third deflecting means comprises a ring shape core arranged within said envelope located to surround said pair of plates and coil located adjacent thereto for generating magnetic flux perpendicular to the direction of said electron beam.

23. A cathode ray tube comprising:

an evacuated envelope means includes a flat envelope comprising a transparent flat base and dish shape base to define a flat space therebetween and a tubular portion provided on one side of said flat envelope to extend therefrom to the outside in lateral relation to said flat space;

a phosphor target formed on the inner surface of said flat base;

an electron gun located within said tubular portion for emitting an electron beam therefrom along a path parallel with said phosphor target, first deflecting means comprising said target and at least one auxiliary electrode located at the inner surface of said dish shape base opposite to said target for impinging said electron beam upon said target;

second deflecting means comprising a pair of plates to put said electron beam therebetween arranged in said flat envelope for electrostatically deflecting said electron beam perpendicularly to said phosphor target; and third deflecting means comprising ring shape magnetic core with coil located adjacent thereto arranged outside of said flat envelope at substantially the same position, along the beam path, as said second deflecting means so as to surround said pair of plates for concentrating magnetic flux generated by means of said third deflecting means on said electron beam between said pair of plates and for electromagnetically deflecting said electron beam in parallel with said phosphor target, thereby to produce an image on said phosphor target.

24. A cathode ray tube according to claim 1, wherein each said pair of plates is trapezoidal in shape expanding in the direction of said electron beam and the distance therebetween and the thickness each thereof being gradually wide and thin, respectively, in the direction of electron beam.

* * * * *